US007559513B2

(12) United States Patent
Kovall

(10) Patent No.: US 7,559,513 B2
(45) Date of Patent: Jul. 14, 2009

(54) PAINT BRUSH HANGER

(76) Inventor: Christopher Kovall, 6785 Rocky Canyon Rd., Creston, CA (US) 93432

( * ) Notice: Subject to any disclaimer, the term of this patent is extended or adjusted under 35 U.S.C. 154(b) by 51 days.

(21) Appl. No.: 11/149,628

(22) Filed: Jun. 9, 2005

(65) Prior Publication Data

US 2006/0278780 A1 Dec. 14, 2006

(51) Int. Cl.
*A46B 17/02* (2006.01)

(52) U.S. Cl. ..... 248/113; 248/213.2; 248/316.8; 220/736

(58) Field of Classification Search ..... 248/213.2, 248/110, 113, 231.81, 231.85, 304, 316.8; 220/736

See application file for complete search history.

(56) References Cited

U.S. PATENT DOCUMENTS

| | | | | | |
|---|---|---|---|---|---|
| 810,640 | A * | 1/1906 | Greener | 220/697 |
| 1,760,346 | A * | 5/1930 | Correa | 24/72.5 |
| 1,940,157 | A * | 12/1933 | Tucker | 248/210 |
| 2,228,593 | A * | 1/1941 | Dibble et al. | 224/42.31 |
| 2,454,474 | A * | 11/1948 | Nance | 248/113 |
| 2,487,516 | A * | 11/1949 | Braswell | 248/110 |
| 2,498,511 | A * | 2/1950 | Smith | 211/65 |
| 2,542,737 | A * | 2/1951 | Vogel | 220/696 |
| 2,625,299 | A * | 1/1953 | Uhlig | 220/736 |
| 2,662,715 | A * | 12/1953 | McKnight | 248/231.61 |
| 2,807,431 | A * | 9/1957 | McHale | 248/113 |
| 2,935,281 | A * | 5/1960 | Huffman | 248/475.1 |
| 3,531,073 | A * | 9/1970 | Cortina | 248/113 |
| 4,890,353 | A * | 1/1990 | Shannon et al. | 15/257.01 |
| 4,951,857 | A * | 8/1990 | Carr | 224/230 |
| 5,662,299 | A * | 9/1997 | Mejia | 248/213.2 |
| 6,361,004 | B1 * | 3/2002 | Witherspoon | 248/213.2 |
| 6,419,194 | B1 * | 7/2002 | LoSacco et al. | 248/113 |
| 7,156,353 | B2 * | 1/2007 | Kringel et al. | 248/311.2 |

* cited by examiner

*Primary Examiner*—Anita M King

(57) ABSTRACT

An apparatus for holding paint brushes on buckets includes a T-shaped member, hooks, and a clip. The hooks are located upon an upper region of the T-shaped member and are spaced substantially equidistant from each other on opposite sides of the upper region of said T-shaped member, the clip being located upon opposite side of T-shaped member from the hooks.

10 Claims, 3 Drawing Sheets

PAINT BRUSH HANGER

FIELD OF THE INVENTION

The present invention is in the area of building and painting materials and pertains more particularly to an apparatus for holding paint brushes on buckets.

BACKGROUND OF THE INVENTION

Painting homes, offices and other objects is a cumbersome process. First, one must carry around containers with paint, brushes, an instrument for rolling the brushes upon, telescoping devices, and other equipment. What's more, one must carry around all this equipment without getting too much paint on their skin and clothes.

Moreover, what complicates this chore even more is when one must paint a two or three story building. In this instance, one must climb up a ladder while lugging around all this equipment. This task is especially difficult without a scaffold where one can simply put down all this equipment on a relatively flat and stable surface.

This process would be much easier to perform if there were a way to carry all these materials and tools with less effort. In addition, this process would become a lot less burdensome if these materials and tools became integrated into one stable piece.

Therefore, what is clearly needed in the art is an apparatus for holding paint brushes in such a way as to enable the painting process with as much ease as possible. A further object would be to make a tool for integrating its placement with another tool to make the process more expedient and useful.

SUMMARY OF THE INVENTION

An apparatus for holding paint brushes on buckets comprising a T-shaped member, hooks, and a clip, said hooks are located upon an upper region of said T-shaped member and are spaced substantially equidistant from each other on opposite sides of said upper region of said T-shaped member; said clip being located upon opposite side of T-shaped member from said hooks; said clip comprising a spring means for closing said clip.

In other preferred embodiments, the apparatus further comprises an elongate member located upon a lower region of said clip; said elongate member being bow-shaped to approximate the curve of a bucket.

In other preferred embodiments, the apparatus has a T-shaped member which is made of plastic. In some other embodiments, the apparatus has a T-shaped member which is made of metal. The apparatus may in some embodiments have a T-shaped member which is made of wood. In some other preferred embodiments, the apparatus may comprise two hooks. The apparatus of in some other embodiments has an elongate member which is made of plastic. The apparatus in some other embodiments may have an elongate member which is made of metal. The apparatus in some preferred embodiments may have an elongate member which is made of wood.

An apparatus for holding paint brushes on buckets comprising a T-shaped member, hooks, a clip, an extension member, a wing nut, and a screw; said hooks are located upon an upper region of said T-shaped member and are spaced substantially equidistant from each other on opposite sides of said upper region of said T-shaped member; said clip being affixed to said T-shaped member by affixing means; said clip comprising a spring means and an extension lever; both said extension member and said extension lever further comprising interlocking teeth for the purpose of detachably engaging each other; both said extension member and said extension lever further comprising windows between the teeth; said screw sized to fit between said windows of both said extension member and extension lever, said screw passed through both said extension member and extension lever and interlocked by said wing nut.

In another preferred embodiment said clip further comprises an elongate member located upon lower region of said extension member; said elongate member being bow-shaped to approximate the curve of a bucket. In other preferred embodiments the T-shaped member is made of plastic or wood. In some preferred embodiments the apparatus comprises two hooks.

BRIEF DESCRIPTION OF THE DRAWING FIGURES

DESCRIPTION OF PREFERRED EMBODIMENTS

According to a preferred embodiment of the present invention, a unique apparatus is used to clip onto buckets to hang paint brushes. The present invention is described in enabling detail below.

Figure 1:
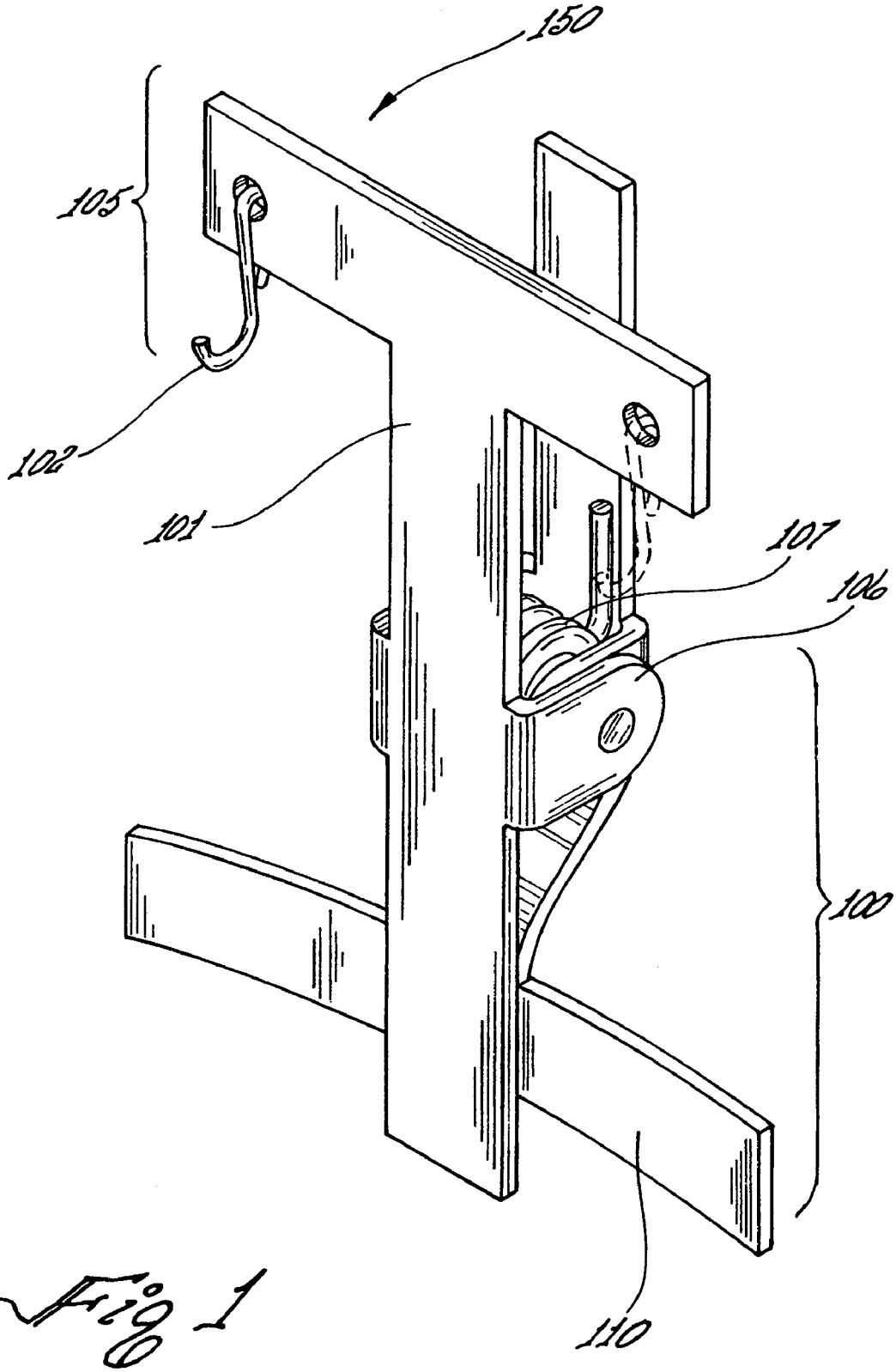
FIG. 1 is a perspective view of a preferred embodiment according to the present invention.
Figure 4:
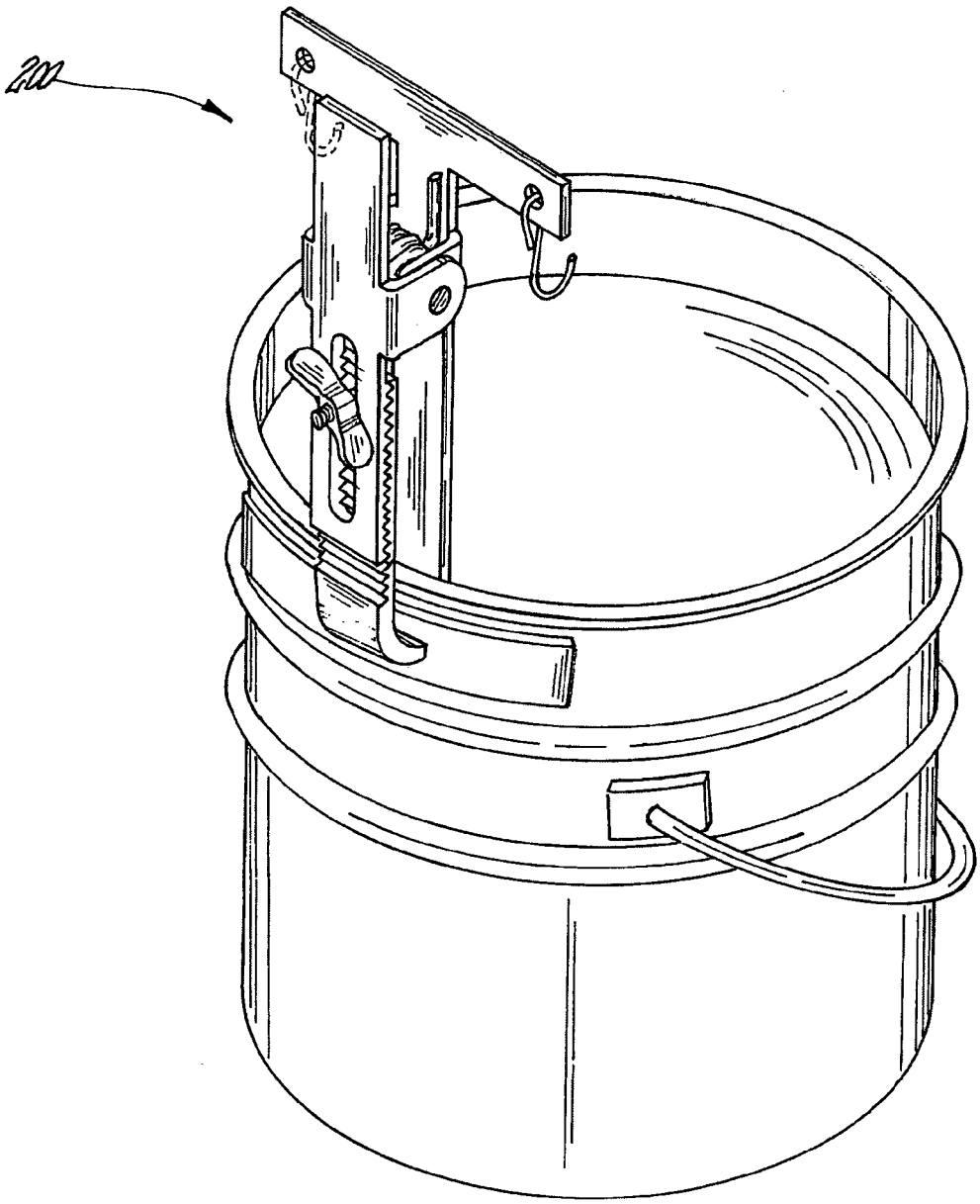
FIG. 4 is a perspective view of a preferred embodiment according to the present invention.

FIG. 1 shows a preferred embodiment of the present invention. Apparatus 150 includes two main regions: clip 100 region and hanger 101 region. Hanger 101 region comprises a "T" shaped design. On the top of the "T" shaped design are two hooks 102. The two hooks 102 are spaced substantially equidistant apart from each other. Hooks 102 are designed to hold the paint brushes. The region of the hanger 101 in which hooks are placed shall hereafter be known as the brush region 105. FIG. 4 illustrates how Apparatus 200 works with bucket in its normal operation.

On the clip region 100 which is opposite to brush region 105 there is a clip 106. Clip 106 is designed to affix apparatus to a bucket. The bottom of clip 106 is designed to be curved to conform to the shape of the bucket. The object of the present invention is to create an interference fit between the clip 106 and the bucket. This is performed by the spring 107 which enables the clip to create a tight fit with the bucket. Clip 106 is well known in the art and it is of no consequence how to make it insofar as the clip 106 substantially creates an interference fit with the bucket. Attached to clip 106 is an elongate member 110. Elongate member 110 is curved in such a way to approximate the curve of the outside of a standard bucket. As the clip 106 and the elongate member is attached to the bucket, both the clip 106 along with the elongate member 110 form an interference fit with the bucket.

The materials used to compose the clip 100 and hanger 101 regions are inconsequential. A panoply of materials may be used to compose said regions. Examples include plastic, metal, wood, polymers, aluminum, etc. The options are endless. As for the clip itself, the spring 107 in a preferred embodiment is composed of a metallic material. However, the rest of the clip 106 may be made with a panoply of different materials. Again, the possibilities are endless.

Figure 2:
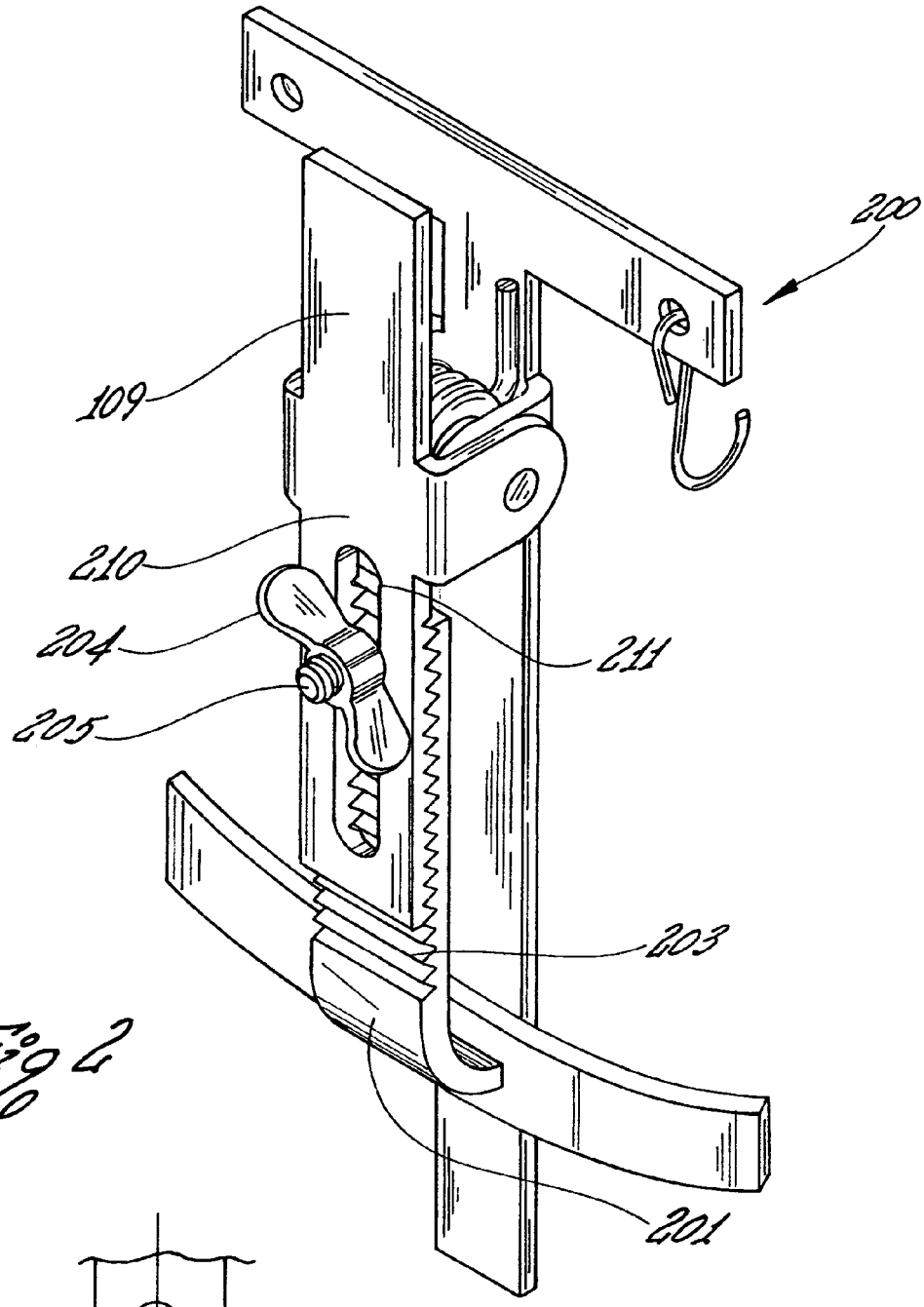
FIG. 2 is a perspective view of a preferred embodiment according to the present invention.
Figure 3:
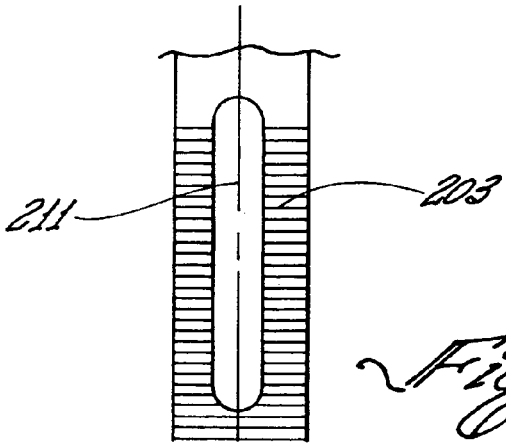
FIG. 3 is a plan view of a preferred embodiment of the present invention.

FIG. 2 and FIG. 4 illustrates another preferred embodiment of the present invention. Extendable brush holder 150 further comprises extension member 201 and extension lever 210. Both extension member 201 and extension lever 210 possess complimentary teeth 203 which engage each other for the purpose of adjusting the size of the extendable brush holder 200. The push member 109 is pressed by user in order to operate the Extendable brush holder 150.

In the center of both extension member 201 and extension lever 210 is a window 211. The purpose of the window 211 is to enable a screw 205 to pass between extension member 201 and extension lever 210 and engage wing nut 204. Once wing nut 204 is threaded onto screw 205, both extension member 201 and extension lever 210 are fully engaged. In addition, extendable brush holder 200 further comprises an elongate member 110 to engage the side of the bucket. However, in this embodiment the elongate member 110 is affixed to said extension member 201.

In order to adjust for the correct size, extendable brush holder 150 is simply disassembled by disengaging the wing nut 204 and screw 205 and teeth 203. The desired length is resolved by interlocking teeth 203 at the desired length of the extendable brush holder 150 and having the wing nut 204 and the screw 205 engaged with each other.

It will be apparent to the skilled artisan that there are numerous changes that may be made in embodiments described herein without departing from the spirit and scope of the invention. As such, the invention taught herein by specific examples is limited only by the scope of the claims that follow.

What is claimed is:

1. An apparatus for holding paint brushes on buckets, comprising a T-shaped member, hooks, a clip, an extension member, a wing nut, and a screw; said hooks are located upon an upper region of said T-shaped member and are spaced substantially equidistant from each other on opposite sides of said upper region of said T-shaped member; said clip being affixed to said T-shaped member by affixing means; said clip comprising a spring means and an extension lever; both said extension member and said extension lever further comprising interlocking teeth for the purpose of detachably engaging each other; both said extension member and said extension lever further comprising windows between the teeth; and said screw sized to fit between said windows of both said extension member and said extension lever, said screw passed through both said extension member and extension lever and interlocked by said wing nut.

2. The apparatus of claim 1 wherein said clip further comprises an elongate member located upon lower region of said extension member; and said elongate member being bow-shaped to approximate the curve of a bucket.

3. The apparatus of claim 1 wherein said T-shaped member is made of plastic.

4. The apparatus of claim 2 wherein said T-shaped member is made of plastic.

5. The apparatus of claim 1 wherein said T-shaped member is made of wood.

6. The apparatus of claim 2 wherein said T-shaped member is made of wood.

7. The apparatus of claim 1 wherein the apparatus comprises two hooks.

8. The apparatus of claim 2 wherein the apparatus comprises two hooks.

9. The apparatus of claim 1 wherein elongate member is made of a metal.

10. The apparatus of claim 2 wherein elongate member is made of a metal.

* * * * *